US005906498A

United States Patent [19]

Nagafuji

[11] Patent Number: 5,906,498

[45] Date of Patent: May 25, 1999

[54] ELECTRICAL CONNECTOR HAVING JOINT STRUCTURE TO CONNECT ELECTRICAL CONNECTING ELEMENT TO CIRCUIT BOARD

[75] Inventor: Toshiaki Nagafuji, Tokyo, Japan

[73] Assignee: NEC Corporation, Japan

[21] Appl. No.: 09/012,397

[22] Filed: Jan. 23, 1998

[30] Foreign Application Priority Data

Jan. 24, 1997 [JP] Japan ..... 9-011650

[51] Int. Cl.[6] ..... H01R 13/15

[52] U.S. Cl. ..... 439/260

[58] Field of Search ..... 439/260, 495

[56] References Cited

U.S. PATENT DOCUMENTS

| | | | |
|---|---|---|---|
| 5,542,855 | 8/1996 | Asai | 439/260 |
| 5,580,272 | 12/1996 | Yamaguchi et al. | 439/495 |
| 5,695,360 | 12/1997 | Seto et al. | 439/495 |

FOREIGN PATENT DOCUMENTS

| | | |
|---|---|---|
| 3-82563 | 8/1991 | Japan . |
| 6-7179 | 1/1994 | Japan . |
| 6-77186 | 10/1994 | Japan . |
| 7-142130 | 6/1995 | Japan . |

*Primary Examiner*—Neil Abrams
*Assistant Examiner*—Barry M. L. Standig
*Attorney, Agent, or Firm*—Ostrolenk, Faber, Gerb & Soffen, LLP

[57] ABSTRACT

An electrical connector includes electrically-conductive contacts (33) held on a base plate portion (31*a*) of a housing (31), and makes the contacts (33) tightly contacted with an electrical connecting element (81) in the form of a flat plate placed on the base plate portion (31*a*). The base plate portion (31*a*) has a first base surface (31*b*) on which the electrical connecting element (81) is placed, and a second base surface (31*c*) positioned adjacent to the first base surface (31*b*). The contacts (33) each have a support post portion (33*a*) held on the base plate portion (31*a*) and extending upward above the first base surface (31*b*), a first beam portion (33*b*) extending from the support post portion (33*a*) in opposed relation to the first base surface (31*b*), and a second beam portion (33*c*) extending from the support post portion (33*a*) in opposed relation to the second base surface (31*c*). An operating member (41) is interposed between the second beam portion (33*c*) and the second base surface (31*c*) to change the spacing between the second beam portion (33*c*) and the second base surface (31*c*), and simultaneously to change the spacing between a contact portion (33*d*) and the first base surface (31*b*) with a joint portion between the second beam portion (33*c*) and the support post portion (33*c*) serving as a fulcrum, so that the electrical connecting element (81) inserted between the first beam portion (33*b*) and the first base surface (31*b*) is tightly grasped therebetween and connected to the contact portion (33*d*).

19 Claims, 6 Drawing Sheets

ELECTRICAL CONNECTOR HAVING JOINT STRUCTURE TO CONNECT ELECTRICAL CONNECTING ELEMENT TO CIRCUIT BOARD

BACKGROUND OF THE INVENTION

The present invention relates to an electrical connector for electrically and mechanically coupling an electrical connecting element in the form of a flat plate, such an FPC (Flexible Printed Circuits) or FFC (Flexible Flat Cables), to a printed circuit board (referred to as a circuit board hereinafter) through electrically-conductive contacts, and more particularly to an electrical connector having a joint structure adapted to connect an electrical connecting element to contacts by moving the element horizontally.

An electrical connector according to Prior Art 1 is constructed such that a slider member is inserted in the same direction as a direction in which the FPC is inserted, whereupon resilient contact portions of contacts are deformed so as to come into contact under reaction forces with electrically-conductive portions provided on a lower surface of an FPC. When the slider member is pushed into place horizontally in the same direction as the direction in which the FPC is inserted, the FPC is pressed downward by a pressing force applied from the slider member to it, and the resilient contact portions of the contacts are deformed through the FPC and sprung back to come into contact with the electrically-conductive portions of the FPC (See, e.g., Japanese Unexamined Utility Model Publication No. 6-7179).

There is also known a modification of the above electrical connector having such a structure that U-shaped contacts are employed and a movable piece is inserted in a direction opposite to the direction in which an FPC is inserted, causing the contacts to partly deform and spring back to come into contact with corresponding electrically-conductive portions which are provided on an upper surface of the FPC. (See, e.g., Japanese Unexamined Patent Publication No. 3-82563).

An electrical connector according to Prior Art 2 employs a pressing member rotatively fitted into place. An FPC is inserted into a gap between the pressing member and contact bosses of contacts before the pressing member is rotated. When pressing member is rotated, it comes closer to the contact bosses while pressing the FPC against the contact bosses, allowing the contact bosses to come into contact with electrically-conductive portions provided on the FPC. (See, e.g., Japanese Unexamined Patent Publication No. 7-142130 and Japanese Unexamined Utility Model Publication No. 6-77186).

As another example of prior art, there is an electrical connector in which substantially L-shaped contacts are displaced to apply a pressure to an FPC for holding it in a fitted state. Specifically, this electrical connector has such a structure that a plate is inserted into one surface side of the contacts from above to displace the contacts downward, whereupon the positions of contact bosses provided on the other surface side of the contacts are changed to such an extent as enough to hold the FPC in place with a satisfactory contact force (See, e.g., U.S. Pat. No. 5,542,855).

The structure of the electrical connector of Prior Art 1 has a problem that the FPC is liable to shift in its position because the slider member is pushed into place while sliding over the FPC and pressing it downward. More specifically, when the slider member is inserted into the housing, it simultaneously imposes a pressing or contact force upon the FPC, thus producing a force tending to shift the FPC in the direction of insertion. In alignment of the FPC and the housing, therefore, relative positions of the contact bosses and the electrically-conductive portions of the FPC are more likely to shift upon insertion of the slider member.

Accordingly, this type of electrical connector has a difficulty in design of making narrower the pitch of the plurality of contacts or thinner the FPC to enhance its strength for the purpose of arraying a larger number of contacts in the housing; hence it has a limit in reducing the size.

Another problem of the above electrical connector is below. An attempt to assemble the contacts in the housing at a higher density and realize a smaller size would necessarily reduce the size of the slider member. This requires a larger operating force to establish connection of a larger number of contacts with the FPC. As a result, the slider member becomes harder to push it into place and the working efficiency is deteriorated.

The structure of the electrical connector of Prior Art 2 has a problem that the contact bosses and the electrically-conductive portions of the FPC are liable to shift in relative position as with the electrical connector of Prior Art 1 because the FPC is also pressed by a force tending to rotate it with respect to the contact bosses.

A problem common to the structures of the electrical connectors of Prior Arts 1, 2 is that the height of the connector cannot be reduced. Specifically, both the connectors have such a structure that the FPC and the slider member or the pressing member are grasped by the U-shaped contacts, i.e., that pressing or contact forces are indirectly applied to the upper surfaces of the resilient contact portion. For this reason, an insulating member (housing) necessarily has a large thickness.

In the other electrical connector using the contacts which are not U-shaped but substantially L-shaped or the like, reaction forces produced upon the contact bosses being displaced to provide the contact forces must be borne by any of the components. Usually, an insulating member called a housing serves to bear such reaction forces. To this end, a wall of the insulating member serving to bear the reaction forces is required to have a sufficiently large thickness.

Further, the conventional electrical connectors have a difficulty in reducing the size because they necessarily have a large height as mentioned above. In addition, since the contact bosses of the electrical connector are displaced downward, it is required to provide a housing wall or the like in position outside the contact bosses. Accordingly, there is a problem that the electrical connectors have a relatively large overall size and are difficult to achieve a reduction in size.

SUMMARY OF THE INVENTION

An object of the present invention is therefore to provide an electrical connector which can prevent a shift in relative position between an electrical connecting element and contacts when both are connected to each other, and which is superior in operability.

An object of the present invention is to provide an electrical connector which has a reduced overall size and can be mounted on a circuit board with higher density.

According to the present invention, there is provided an electrical connector comprising a housing of a electrically-insulating material which has a base plate portion, and electrically-conductive contacts assembled in the housing, the connector electrically and mechanically coupling an electrical connecting element in the form of a flat plate and the contacts to each other, wherein the base plate portion has a first base surface on which the electrical connecting element is placed, and a second base surface positioned adjacent to the first base surface; the contacts each have a support post portion held on the base plate portion and extending upward above the first and second base surfaces, a first beam portion extending from the support post portion in opposed relation to the first base surface, and a second beam portion extending from the support post portion in opposed relation to the second base surface; the first beam portion has a contact portion facing the first base surface; and operating means is interposed between the second beam portion and the second base surface to change the spacing between the second beam portion and the second base surface, and simultaneously to change the spacing between the contact and the first base surface with a joint portion between the second beam portion and the support post portion serving as a fulcrum, so that the electrical connecting element inserted between the first beam portion and the first base surface is tightly grasped therebetween and connected to the contacts.

Also, in the above electrical connector of the present invention, preferably, the contacts each have a first base beam portion extending from the support post portion and held on the base plate portion, and a second base beam portion extending from the support post portion in a direction opposed to the first base beam portion and held on the base plate portion.

In the above electrical connector of the present invention, preferably, a boss is formed at a tip end of the second beam portion to project in a direction toward the second base surface, and the operating means is rotatably grasped between the boss and the second base surface.

In the above electrical connector of the present invention, preferably, a thickness of the rotating base portion is changed gradually in a direction of rotation thereof to widen the spacing between the second beam portion and the second base surface correspondingly when the control lever portion is pushed to rotate downward from a state where the rotating base portion is rotatably meshed with the boss and the other end of the control lever portion is located above the boss.

In the above electrical connector of the present invention, preferably, the housing has a receiving space for receiving the plurality of contacts, the receiving space being defined by a base plate portion, a cover plate portion extending in opposed relation to the base plate portion, and a pair of side plate portions interconnecting the base plate portion and the cover plate portion at both ends thereof; the receiving space has an insertion opening defined on one side thereof in such a configuration as allowing the electrical connecting element to be inserted there, and an operation opening defined on the opposite side to the insertion opening in such a configuration as allowing the operating means to be combined with the operation opening; and the first and second beam portions are placed in the receiving space while leaving a gap with respect to the cover plate portion.

Further, in the above electrical connector of the present invention, preferably, an arc-shaped boss is formed at a tip end of the second beam portion to project in a direction toward the second base surface, and the operating means is a lever member, the lever member comprising a control lever portion and a rotating base portion joined to one end of the control lever portion, the rotating base portion having an arc-shaped recess rotatably meshed with the boss; and shafts are provided in at least ones of the pair of side plate portions and a pair of side surfaces of the rotating base portion positioned to face the pair of side plate portions, and shaft holes capable of rotatably engaging the shafts are formed in the others of the pair of side plate portions and the pair of side surfaces of the rotating base portion positioned to face the pair of side plate portions, in order that the lever member is rotatably assembled in the operation opening.

DESCRIPTION OF THE PREFERRED EMBODIMENTS

Prior to describing preferred embodiments of the present invention, conventional electrical connectors will be first explained below.

Figure 1:
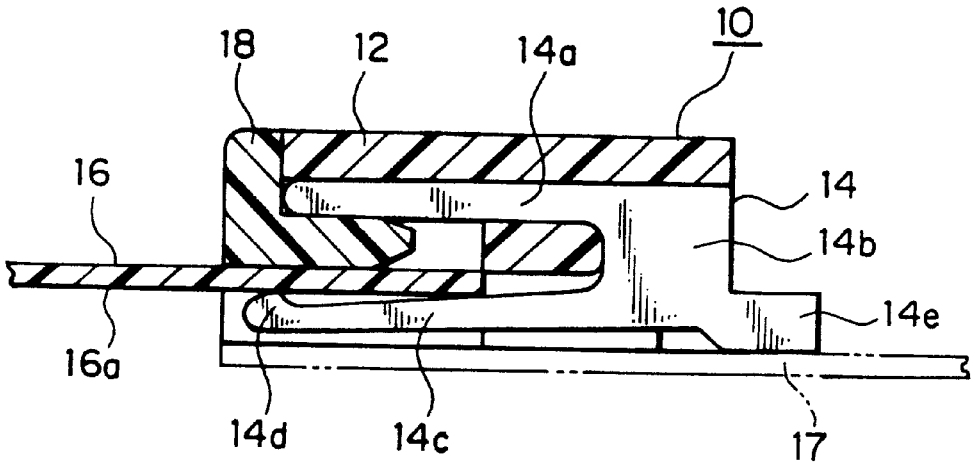
FIG. 1 PRIOR ART
FIG. 1 is a sectional view showing one example of conventional electrical connectors employing a slider member.

An electrical connector 10 according to Prior Art 1, comprises, as shown in FIG. 1, a housing 12 of an electrically-insulating material, a plurality of electrically-conductive contacts 14 assembled in the housing 12, and an slider member 18 of an electrically-insulated material for pressing an FPC 16 against the contacts 14 and locking the FPC 16 in the housing 12.

The contacts 14 each comprise a base portion 14*a* fixed to extend along a top plate of the housing 12, a coupling portion 14*b* connected to one end of the base portion 14*a*, a resilient contact portion 14*c* projecting from the coupling portion 14*b* to extend in a direction parallel to the base portion 14*a*, and a terminal portion 14*e* extending outward of the housing 12.

The electrical connector 10 is mounted on a circuit board 17. When the electrical connector 10 is mounted on the circuit board 17, the terminal portions 14*e* of the contacts 14 are connected to respective electrically-conductive portions of the circuit board 17.

Each of the contacts 14 has a substantially U-shape defined by the coupling portion 14*b*, the base portion 14*a* and the resilient contact portion 14*c*, the latter two being connected to the opposite ends of the coupling portion 14*b*.

The slider member 18 and the FPC 16 are both inserted between the base portion 14*a* and the resilient contact portion 14*c*. At this time, the FPC 16 is grasped between the slider member 18 and the resilient contact portion 14*c* to press the resilient contact portion 14*c*. Simultaneously, an electrically-conductive portion 16*a* of the FPC 16 is brought into contact with a corresponding contact boss 14*d* under the pressing force imposed from the FPC 16 onto the resilient contact portion 14*c*.

Thus, in the electrical connector 10, the slider member 18 is inserted in the same direction as a direction in which the FPC 16 is inserted, whereupon the resilient contact portion 14*c* is deformed so that it comes into contact under a reaction force with the electrically-conductive portion 16*a* provided on a lower surface of the FPC 16. When the slider member 18 is pushed into between the FPC 16 and the base portion 14*a* in the same direction as the direction in which the FPC 16 is inserted, while applying a pressing force to the FPC 16, the resilient contact portion 14*c* is deformed through the FPC 16 and sprung back to come into contact with the electrically-conductive portion 16*a*. (See, e.g., Japanese Unexamined Utility Model Publication No. 6-7179).

There is also known a modification of the electrical connector shown in FIG. 1. Though not illustrated, the modified electrical connector has such a structure that U-shaped contacts are assembled in a housing and a movable piece is inserted in a direction opposite to the direction in which an FPC is inserted, causing the contacts to partly deform and spring back to come into contact with corresponding electrically-conductive portions which are provided on an upper surface of the FPC. In this modification, forces produced upon deformation of the contacts are borne by a top plate of the housing. (See, e.g., Japanese Unexamined Patent Publication No. 3-82563).

Figure 2:
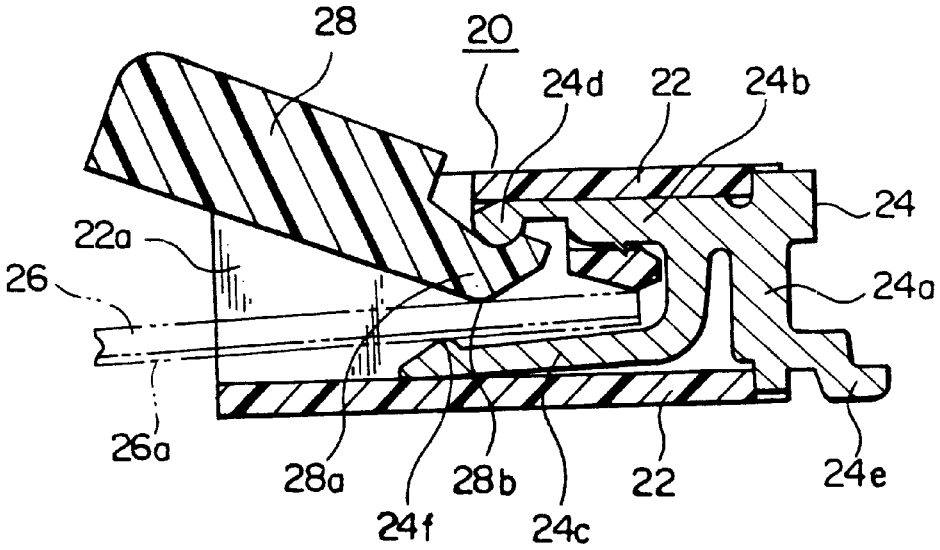
FIG. 2 PRIOR ART
FIG. 2 is a sectional view showing one example of conventional electrical connectors employing a pressing member.

An electrical connector 20 according to Prior Art 2 comprises, as shown in FIG. 2, a housing 22 of an electrically-insulating material, a plurality of electrically-conductive contacts 24 assembled in the housing 12 and having resilient contact portions 24*c* arrayed side by side, and a pressing member 28 of an electrically-insulating material rotatably combined with the housing 22 and pushed into an opening 22*a* which is formed in an upper portion of the housing 22 on one side thereof.

Each of the contacts 24 held in the housing 22 has a support portion 24*d* positioned adjacent to the opening 22*a*. The pressing member 28 has a pressing portion 28*a* for pressing an FPC 26, which is placed on the resilient contact portions 24*c*, against the resilient contact portions 24*c* when the pressing member 28 is rotated into a predetermined position.

The contacts 24 each comprise a coupling portion 24*a* held in the housing 22, an arm portion 24*b* connected to the coupling portion 24*a* and extended along a top plate of the housing 22, the resilient contact portions 24*c* extending along a bottom plate of the housing 22, and a terminal portion 24*e* connected to the coupling portion 24*a* and extending outward of the housing 22.

The arm portion 24*b* and the resilient contact portion 24*c* jointly define a substantially U-shape. The support portion 24*d* is substantially semicircular and formed at an end of the arm portion 24*b* which is positioned adjacent to the opening 22*a*, allowing the pressing member 28 to rotate about the support portion 24*d*.

The FPC 26 is inserted into a fitting space defined between the pressing member 28 and a contact boss 24*f* which is formed at a tip of each resilient contact portion 24*c*, with electrically-conductive portions 26*a* facing down. Then, upon the pressing member 28 being rotated downward as viewed on the drawing sheet of FIG. 2, a pressing corner 28*b* of the pressing portion 28 is brought into abutment with the FPC 26. The pressing force applied from the pressing member to the FPC 26 has a maximum value at the time when the pressing corner 28*b* reaches a vertical line passing the center of the rotation support portion 24*d* of the contact 24. The pressing member 28 is further rotated into the predetermined position while reducing the pressing force. In the predetermined position, the pressing member 28 presses the FPC 26 from the side of its upper surface with an appropriate pressing force (See, e.g., Japanese Unexamined Patent Publication No. 7-142130 and Japanese Unexamined Utility Model Publication No. 6-77186).

As another example of prior art, though not shown, there is an electrical connector in which substantially L-shaped contacts are displaced to apply a pressure to an FPC for holding it in a fitted state. Specifically, this electrical connector has such a structure that a plate is inserted into one surface side of the contacts from above to displace the contacts downward, whereupon the positions of contact bosses provided on the other surface side of the contacts are changed to such an extent as enough to hold the FPC in place with a satisfactory contact force (See, e.g., U.S. Pat. No. 5,542,855).

The structure of the electrical connector 10 of Prior Art 1 has a problem that the FPC 16 is liable to shift in its position because the slider member 18 is pushed into place while sliding over the FPC 16 and pressing it downward. More specifically, prior to insertion of the slider member 18, the FPC 16 can be easily inserted in place. But when the slider member 18 is inserted into the housing 12, it simultaneously imposes a pressing or contact force upon the FPC 16, thus producing a force tending to shift the FPC 16 in the direction of insertion. In alignment of the FPC 16 and the housing 12, therefore, relative positions of the contact bosses 14*d* and the electrically-conductive portions 16*a* of the FPC 16 are more likely to shift upon insertion of the slider member 18.

Accordingly, this type of electrical connector 10 has a difficulty in design of making narrower the pitch of the plurality of contacts 14 or thinner the FPC 16 to enhance its strength for the purpose of arraying a larger number of contacts 14 in the housing 12; hence it has a limit in reducing the size.

Another problem of the electrical connector 10 is below. An attempt to assemble the contacts 14 in the housing 12 at a higher density and realize a smaller size would necessarily reduce the size of the slider member 18. This requires a larger operating force to establish connection of a larger number of contacts 14 with the FPC 16. As a consequence, the slider member 18 becomes harder to push it into place, and the working efficiency is deteriorated.

The structure of the electrical connector 20 of Prior Art 2 has a problem that the contact bosses 24*f* and the electrically-conductive portions 26*a* of the FPC 26 are liable to shift in relative position as with the electrical connector 10 of Prior Art 1 because the FPC 26 is also pressed by a force tending to rotate it with respect to the contact bosses 24*f* as the pressing member 28 is rotated and pushed into place.

A problem common to the structures of the electrical connectors 10, 20 of Prior Arts 1, 2 is that the height of the connector cannot be reduced. Specifically, both the connectors have such a structure that the FPC 16 or 26 and the slider member 18 or the pressing member 28 are grasped by the U-shaped contacts 14 or 24, i.e., that pressing or contact forces are indirectly applied to the upper surfaces of the resilient contact portion 14*c* or 24*c*. For this reason, an insulating member (housing) surrounding those components necessarily has a large thickness.

In the other electrical connector using the contacts which are not U-shaped but substantially L-shaped or the like, reaction forces produced upon the contact bosses being displaced to provide the contact forces must be borne by any of the components. Usually, an insulating member called a housing serves to bear such reaction forces. To this end, a wall of the insulating member serving to bear the reaction forces is required to have a sufficiently large thickness.

Further, the conventional electrical connectors have a difficulty in reducing the size because they necessarily have a large height as mentioned above. In addition, since the contact bosses of the electrical connector are displaced downward, it is required to provide a housing wall or the like in position outside the contact bosses. Accordingly, there is a problem that the electrical connectors 10, 20 have a relatively large overall size and are difficult to achieve a reduction in size.

Preferred embodiments of the present invention will be described below with reference to the drawings.

Figure 3:
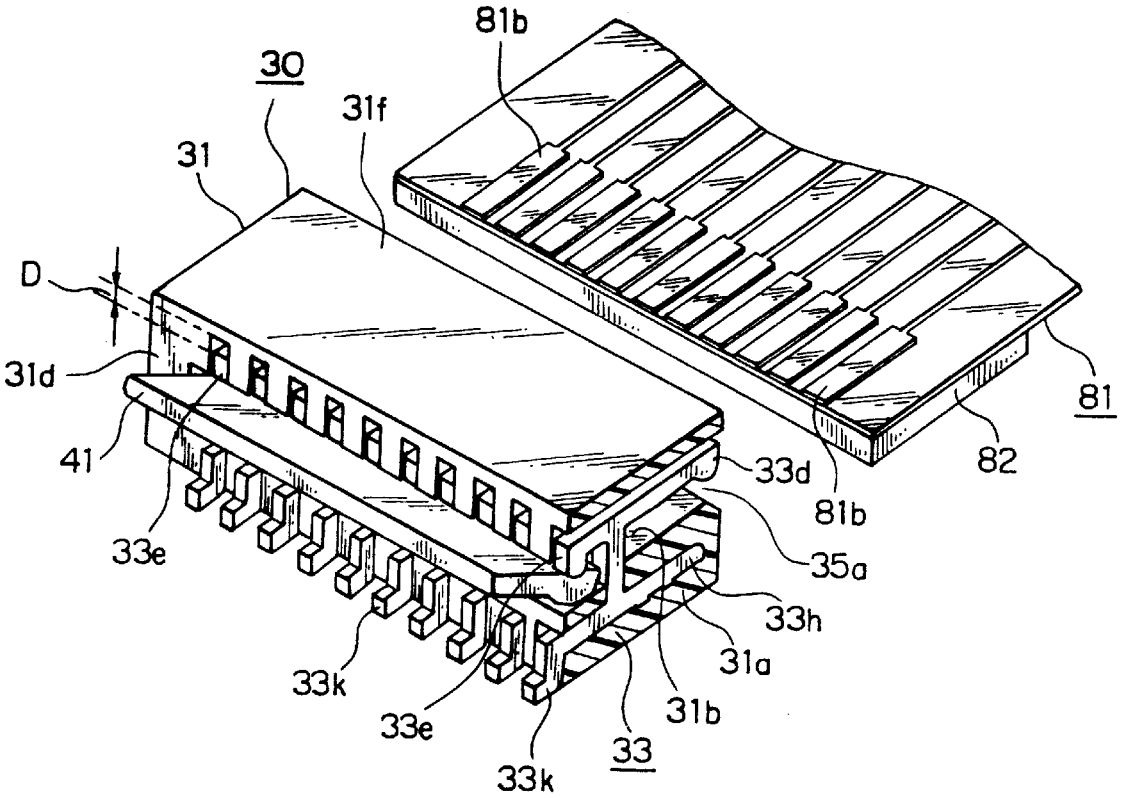
FIG. 3 illustrates one embodiment of an electrical connector of the present invention, and is a perspective view showing a state before an FPC to be connected to the electrical connector is connected thereto.

FIG. 3 shows a first embodiment of an electrical connector of the present invention. FIG. 3 also shows an electrical connecting element in the form of a flat plate, such as an FPC or FFC, which is not yet connected to the electrical connector. Note that, in FIG. 3, operating means described later is shown in the simplified form.

Figure 4:
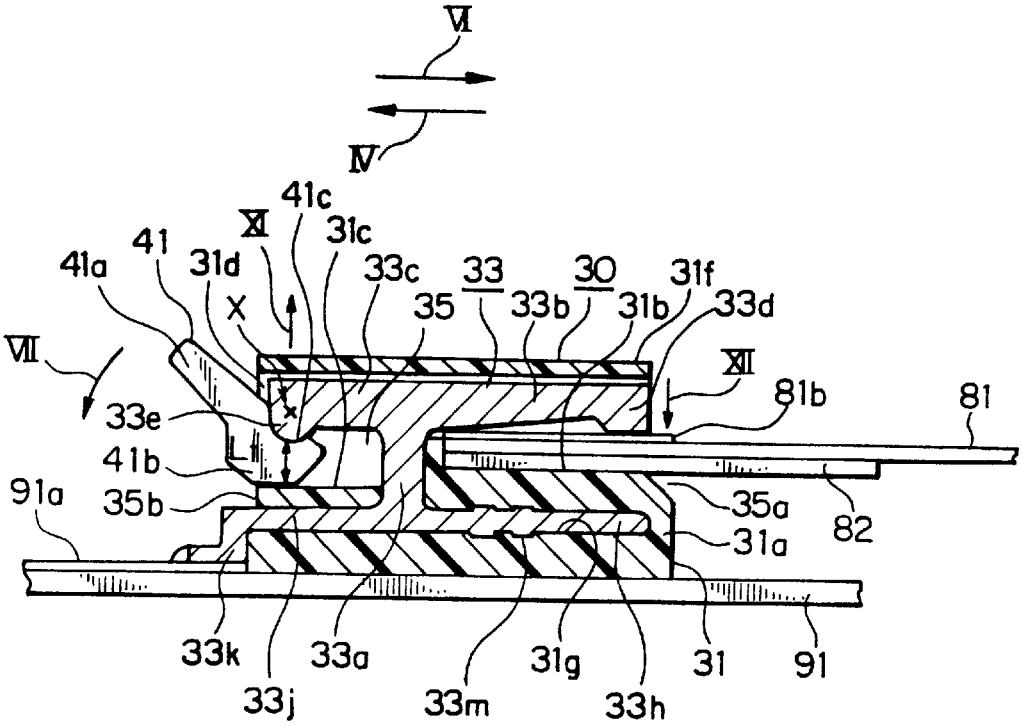
FIG. 4 illustrates the electrical connector of FIG. 3 in more detail, and is a side sectional view showing a state where the FPC is inserted into the electrical connector, but a lever member is not yet operated.
Figure 5:
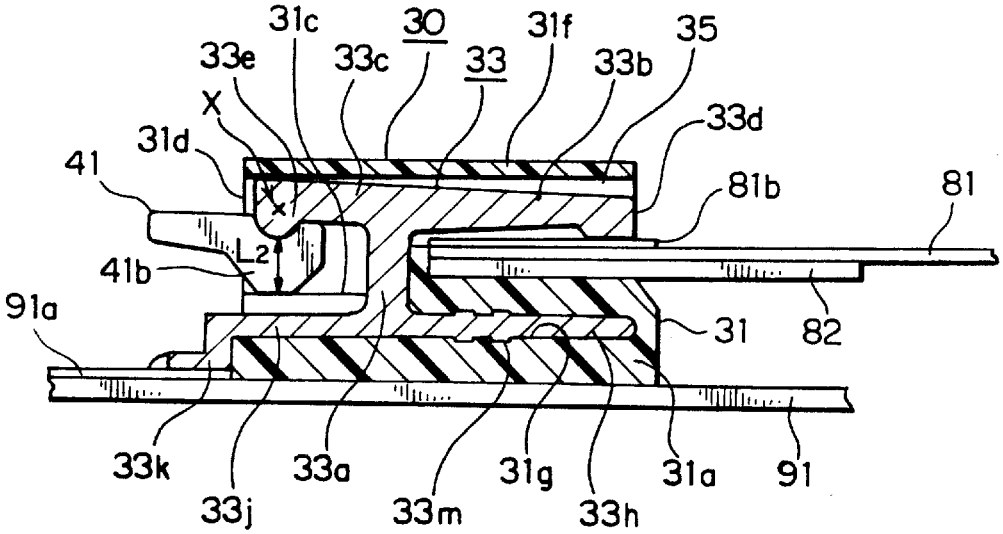
FIG. 5 is a side sectional view showing a state where the lever member provided on the electrical connector shown in FIG. 4 have been operated and the FPC and the contacts are completely contacted with each other.

FIGS. 4 and 5 show the electrical connector of FIG. 3 in more detail. FIG. 4 illustrates a state where the electrical connecting element is inserted into the electrical connector. FIG. 5 illustrates a state where the electrical connecting element has been inserted into the electrical connector such that both the components are electrically and mechanically connected to each other.

Referring to FIGS. 3 to 5, an electrical connector 30 according to the first embodiment comprises a housing 31 of an electrically-insulating material, a plurality of electrically-conductive contacts 33 assembled in the housing 31 to be arranged in a first direction, and operating means 41 for enabling an FPC 81 to be connected and disconnected to and from the contacts 33 in a freely attachable/detachable manner.

The housing 31 is made up of a base plate portion 31*a*, a cover plate portion 31*f* positioned above the base plate portion 31*a* and extending parallel to the base plate portion 31*a*, and a pair of side plate portions 31*d* lying perpendicularly to the base plate portion 31*a* and the cover plate portion 31*f* and joined to both ends of the base plate portion 31*a* and the cover plate portion 31*f*. Incidentally, only one of the side plate portions 31*d* on the back side appears in FIGS. 3 to 5.

Further, the housing 31 has a receiving space 35 for receiving the plurality of contacts 33 (see FIGS. 4 and 5). In the receiving space 35, the plurality of contacts 33 are arranged to extend in a first direction IV indicated by a right-heading arrow and a second direction VI opposed to the first direction IV, and to space from each other in parallel relation with predetermined intervals therebetween in a direction perpendicular to the drawing sheet of FIG. 4.

The receiving space 35 has an insertion opening 35*a* defined on one side thereof in such a configuration as allowing a leading end portion of the FPC 81 to be inserted there, and an operation opening 35*b* defined on the opposite side to the insertion opening 35*a* in such a configuration as allowing the operating means 41 to be combined (fitted) therewith.

The base plate portion 31*a* has a first base surface 31*b* on which the FPC 81 inserted through the insertion opening 35*a* in the first direction IV is rested, and a second base surface 31*c* being adjacent to the first base surface 31*b* and extending in the first direction IV from a central portion.

The contacts 33 each have a support post portion 33*a* held on the base plate portion 31*a* and extending upward above the first and second base surfaces 31*b*, 31*c*, and a first beam portion 33*b* extending in the second direction VI from an upper end of the support post portion 33*a* parallel to the first base surface 31*b*. The contact 33 also has a second beam portion 33*c* extending in the first direction IV from the upper end of the support post portion 33*a* parallel to the second base surface 31*c*.

The first and second beam portions 33*b*, 33*c* are arranged in the receiving space 35 while leaving gaps (indicated by V in FIG. 3) with respect to the cover plate portion 31*f*.

The first beam portion 33*b* has a contact portion or a contact boss 33*d* formed at its tip end. The contact boss 33*d* projects toward the first base surface 31*b*. In other words, the contact boss 33*d* faces the first base surface 31*b*. The second beam portion 33*c* has a boss 33*e* formed at its tip end and projecting toward the second base surface 31*c*. The boss 33*e* meshes or engages with the operating means 41, as described later. The operating means 41 is disposed such that its part is grasped between the second beam portion 33*c* and the second base surface 31*c*. The operating means 41 functions to change the spacing between the second beam portion 33*c* and the second base surface 31*c*, and at the same time change the spacing between the contact boss 33*d* and the first base surface 31*b* with a joint portion between the second beam portion 33*c* and the support post portion 33*a* serving as a fulcrum.

The contact 33 further has a first base beam portion 33*h* extending in the second direction VI from the support post portion 33*a* and held on the base plate portion 31*a*, and a second base beam portion 33*j* extending in the first direction IV from the support post portion 33*a* and held on the base plate portion 31*a*. The first base beam portion 33*h* is held by the base plate portion 31*a* by being press-fitted into a retaining hole 31*g* formed in the base plate portion 31*a*.

As shown in FIGS. 3 and 4, a terminal portion 33*k* is formed to extend from the second base beam portion 33*j* outward beyond the base plate portion 31*a* for connection to a corresponding electrically-conductive portion 91*a* of a circuit board 91 on which the base plate portion 31*a* is mounted. Since the terminal portion 33*k* is only required to be provided on at least one of the first and second base beam portions 33*h*, 33*j*, it may be formed to extend from the first base beam portion 33*h* outward beyond the base plate portion 31*a* for connection to the corresponding electrically-conductive portion 91*a* of the circuit board 91.

Further, as shown in FIGS. 4 and 5, the first base beam portion 33*h* has lock projections 33*m* formed thereon for locking it to an inner wall of the retaining hole 3l*g* in the base plate portion 31*a*. Other locking projections similar to the lock projections 33*m* may also be formed on the second base beam portion 33*j*. Moreover, though not shown, similar locking projections may be formed on part of the support post portion 33*a* for locking the contact 33 to the base plate portion 31*a*.

Figure 6:
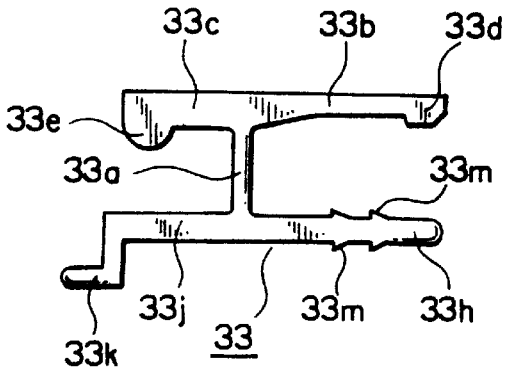
FIG. 6 is a sectional view showing another practical example of the contact provided in the electrical connector of the present invention.

FIG. 6 shows another practical example of the contact 33. The contact 33 shown in FIG. 6 has a configuration analogous to that of the contact 33 shown in FIGS. 4 and 5.

Therefore, parts of the contact 33 shown in FIG. 6 are denoted by the same numerals as used for the contact 33 shown in FIGS. 4 and 5. The contact 33 of FIG. 6 differs from the contact 33 shown in FIGS. 4 and 5 slightly in detailed dimension and shape, but functions in the same manner.

Figure 7:
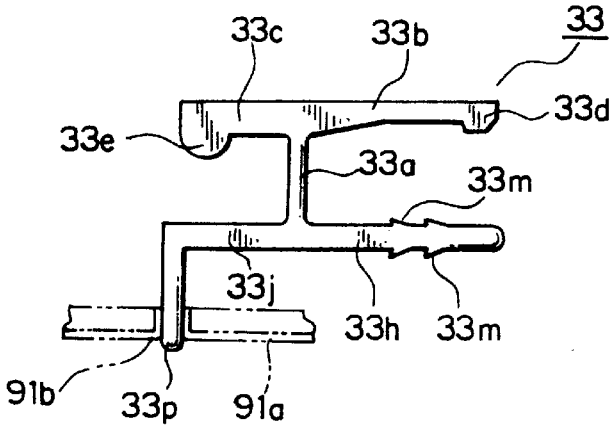
FIG. 7 is a sectional view showing still another practical example of the contact provided in the electrical connector of the present invention.

FIG. 7 shows still another practical example of the contact 33. The contact 33 of FIG. 7 also differs from the contact 33 shown in FIGS. 4 and 5 slightly in detailed dimension and shape, but functions in the same manner. The contact 33 of FIG. 7 differs from the contact 33 shown in FIGS. 4 and 5 in that a terminal portion 33 for connection to a through-hole is formed at an end of the second base beam portion 33*j*.

More specifically, as shown in FIG. 7, connection between the contact 33 and the circuit board 91 can be realized in such a manner as inserting part of the contact 33 into a through-hole 91*b* formed in the circuit board 91 and fixing it there by soldering, other than mounting the contact 33 on a surface of the circuit board 91. The terminal portion 33*p* soldered to the through-hole 91*b* is formed to extend outward beyond a bottom surface of the base plate portion 31*a* so that it can be inserted into the through-hole 91*b* formed in the circuit board 91, on which the base plate portion 31*a* is disposed, and connected to a corresponding electrically-conductive portion 91*a* provided on the circuit board 91.

Figure 8:
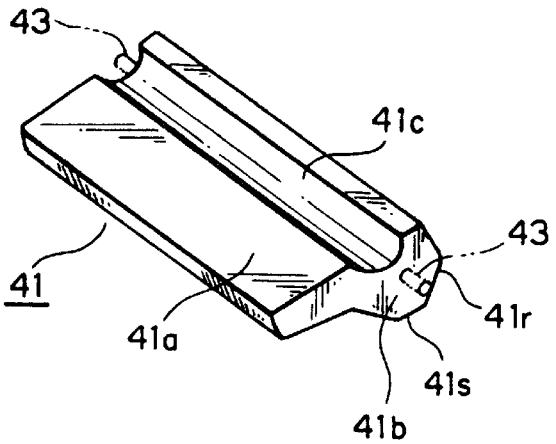
FIG. 8 is a perspective view showing another practical example of the lever member provided in the electrical connector of the present invention.

Constructions of the second beam portion 33*c* of the electrical connector 30 and the operating means 41 will be described below in more detail with reference to FIGS. 8 and 9 as well as FIGS. 3 to 5.

The operating means 41 explained above in connection with FIG. 3 is formed as a lever member 41. Depending on configurations of the lever member 41, the connector may be possibly easily brought into an open state when an external force is applied to the connector. To cope with such a drawback, it is conceivable to, for example, provide lock means for locking the lever member 41 to the housing 31. However, the presence of such lock means would deteriorate easiness in operation for connecting the FPC 81 to the connector. In view of the above, the lever member 41 is constructed, as described below, so that the connector is not easily brought into an open state even when an external force such as vibration is applied to the connector.

FIGS. 4, 5, 8 and 9 show a practical example of the lever member 41 in detail which can prevent the connector from being easily brought into an open state.

The boss 33*e* of the second beam portion 33*c* has an arc-shaped surface in cross-section. The operating means 41 shown in those drawings is the lever member 41. The lever member 41 comprises a control lever portion 41*a* and a rotating base portion 41*b* joined to one end of the control lever portion 41*a* and being thicker than the control lever portion 41*a*.

The rotating base portion 41*b* has an arc-shaped recess 41*c* rotatably meshing with the boss 33*e*, and first and second cam surfaces 41*r*, 41*s* formed to change a thickness of the rotating base portion 41*b* into L1, L2, respectively, in a direction in which the lever member 41 is rotated.

Figure 9:
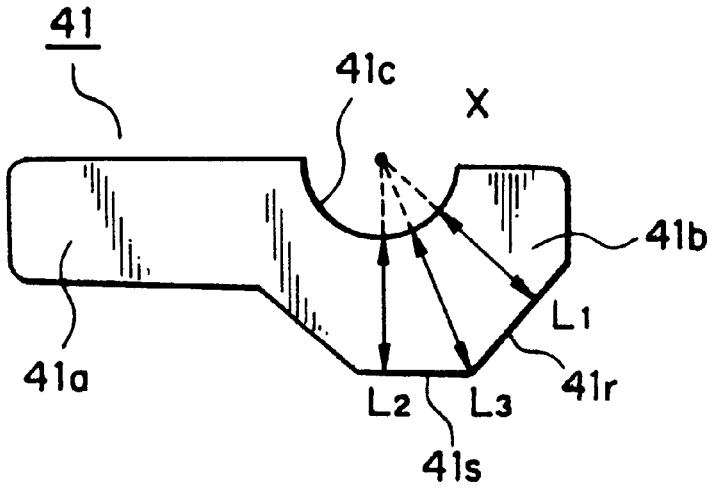
FIG. 9 is a side view for explaining the operation of the lever member shown in FIG. 4.

Here, an important point is the relationship among the thicknesses L1, L2 and L3 of the rotating base portion 41*b* shown in FIGS. 4, 5 and 9. The thickness L3 is set to a value which is intermediate between the thicknesses L1 and L2 and is larger than the thickness L2. By so setting the value of L3, a force applied to the lever member 41 during the rotation of the lever member 41 exceeds a maximum produced at an angled point corresponding to the thickness L3. This contributes to stably holding the lever member 41 is a fitted state.

Figure 10:
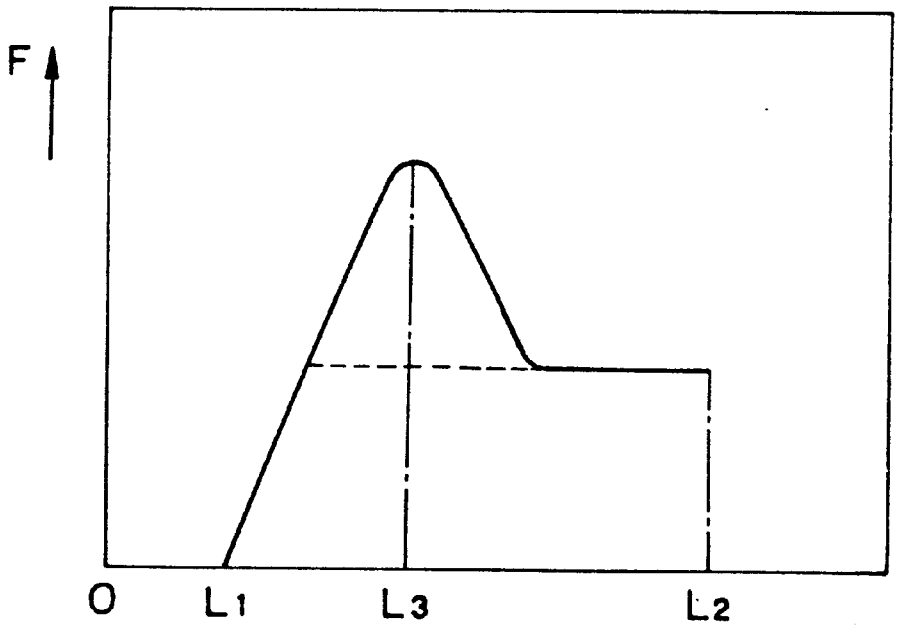
FIG. 10 is a chart showing the relationship between a displacement and a force resulted when the lever member shown in FIG. 4 is operated.

FIG. 10 graphically shows the relationship between a force F applied to the rotating base portion 41*b* of the lever member 41 and a displacement in a direction toward the rotation center X of the rotating base portion 41*b* of the lever member 41. As seen from FIG. 10, while the lever member 41 is rotating, the force F has a maximum peak at the thickness L3, and thereafter the lever member 41 reaches a final contact point corresponding to L2 (with the second cam surface 41*s*). In other words, the lever member 41 must ride over the angled point corresponding to the thickness L3 for being rotated backwardly from the final contact point (L2) to the open state (L1). The lever member 41 is thus kept from being brought back to the open state due to vibration, etc. For developing such a lock function of the lever member 41, it is of course important to set the thicknesses L1, L2 and L3 to proper values. In setting of the thickness L3, a care must be taken in design so that the contact 33 will not be subject to excessive stresses.

The spacing between the second beam portion 33*c* and the second base surface 31*c* is changed depending on differences of the thicknesses L1, L2 of the rotating base portion 41*b* as the lever member 41 is rotated in a direction indicated by an arrow VII in FIG. 4. This is because the first and second cam surfaces 41*r*, 41*s* contact with the second base surface 31*c* in this order with the rotation of the lever member 41.

The recess 41*c* of the rotating base portion 41*b* is formed to change the thicknesses L1, L2 of the rotating base portion 41*b*, as stated above, and cooperates with the boss 33*e* in widening the spacing between the second beam portion 33*c* and the second base surface 31*c* when the control lever portion 41*a* is pushed to rotate downward from an initial state where the other end of the control lever portion 41*a* is located above the boss 33*e*.

Stated otherwise, the thicknesses L1, L2 of the rotating base portion 41*b* are set to meet the relationship of L1<L2 in order that the spacing between the second beam portion 33*c* and the second base surface 31*c* is larger before pushing down the control lever portion 41*a* than after pushing down it.

The foregoing description has been made as holding the lever member 41 at the rotating base portion 41*b* thereof by the boss 33*e* of the contact 33. To prevent the lever member 41 from being easily dislodged from the boss 33*e*, however, it is advantageous that shafts 43 provided on the lever member 41 are rotatably fitted to and locked in holes (not shown) formed in the housing, as shown in FIG. 8.

The lever member 41 is rotatably assembled into the operation opening 35*b* of the receiving space 35. The lever member 41 has a pair of shafts 43, indicated by two-dot-chain lines in FIG. 8, provided on a pair of its side surfaces which lie perpendicularly to the longitudinal direction of the rotating base portion 41*b*. A pair of shaft holes (not shown) rotatably engaging with the corresponding shafts 43 are formed in the pair of side plate portion 31*d* of the housing 31 shown in FIGS. 3 to 5. Note that the shafts 43 and the shaft holes may be provided on the pair of side plate portion 31*d* of the housing 31 and the pair of side surfaces of the lever member 41 lying perpendicularly to the longitudinal direction of the rotating base portion 41*b*, respectively, as opposed to the above fitting relation.

In the electrical connector 30 explained above, the contact 33 shown in FIGS. 3 to 7 has a substantially H-shape turned 90° as viewed from the side, when it is held on the base plate portion 31*a*.

Other than such a substantially H-shape, however, the contact 33 may be in the form of a substantially T-shape resulted by omitting the first and second base beam portions 33*h*, 33*j*, or may be shaped such that the first and second base beam portions 33*h*, 33*j* have a very short length.

Further, the plate thickness and width of the support post portion 33*a* are appropriately selected in design so that when the second beam portion 33*c* is displaced, a predetermined displacement is developed in the first beam portion 33*b* in response to the displacement of the second beam portion 33*c*.

Returning to FIGS. 3 to 5, as stated above, the FPC 81 is inserted into between the first beam portion 33*b* and the first base surface 31*b* through the insert opening 35*a* of the receiving space 35. The FPC 81 comprises a base film 81*a* of electrically-insulating material, and electrically-conductive portions (pad portions) 81*b* provided on an upper surface of the base film 81*a*. In this embodiment, a reinforcing plate 82 is bonded to a lower surface of the base film 81*a* opposite to the electrically-conductive portions 81*b*. The reinforcing plate 82 rests on the first base surface 31*b* when the FPC 81 is inserted in place.

The operation of inserting and removing the FPC 81 into and from the electrical connector 30 will now be described with reference to FIGS. 4 and 5.

First, as shown in FIG. 4, the leading end portion of the FPC 81 is inserted in the housing 31 between the first beam portion 33*b* and the first base surface 31*b* to reach a predetermined position. In this state, the lever member 41 is not yet operated. Also, the electrical connector 30 is mounted on the circuit board 91 by SMT (Surface Mount Technology) such that the terminal portions 33*k* of the contacts 33 are connected by soldering respectively to the corresponding electrically-conductive portion 91*a* of the circuit board 91.

The contacts 33 are each locked to the base plate portion 31*a* of the housing 31 by the lock projections 33*m* with a holding force sufficient for permitting the lever member 41 to be operated and handled without problems. The lever member 41 is rotated about an imaginary rotation center X, shown in FIGS. 4, 5 and 9, locating in the second beam portion 33*c*. When the lever member 41 is oriented with a large angle relative to the circuit board 91, the electrical connector is in the open state where the FPC 81 and the contacts 33 are not tightly contacted with each other. In other words, as detailed in FIG. 4, part of the rotating base portion 41*b* of the lever member 41 corresponding to the thickness L1 is interposed between the second beam portion 33*c* and the second base surface 31*c* so that the first beam portion 33*b* is not elevated when the FPC 81 is inserted in place. At this time, the first cam surface 41*r* of the rotating base portion 41*b* is held in contact with the second base surface 31*c*.

Then, when the lever member 41 is rotated to a state (FIG. 5) substantially parallel to the circuit board 91 by pushing the control lever portion 41*a* downward, the second beam portion 33*c* is elevated in a direction indicated by an arrow XI in FIG. 4. Conversely, the first beam portion 33*b* is lowered in a direction indicated by an arrow XII in FIG. 4. Here, the thickness L2 of the rotating base portion 41*b* of the lever member 41 is so set that the electrically-conductive portions 81*b* of the FPC 81 and the contact bosses 33*d* are brought into close contact with each other. The thickness L2 of the rotating base portion 41*b* represents a distance from an inner surface of the recess 41*c* to the second cam surface 41*s* along a line vertically extending downward from the imaginary rotation center X to which the second cam surface 41*s* intersects perpendicularly in this state. As mentioned above, the thicknesses L1, L2 of the rotating base portion 41*b* of the lever member 41 are set to meet the relationship of L1<L2.

Referring to FIG. 5, it will be understood that each pair of the contact boss 33*d* and the electrically-conductive portion 81*b* of the FPC 81 are connected to each other under an appropriate contact force. Also, as seen from FIG. 5, the second beam portion 33*c* and the first beam portion 33*b* are displaced about the support post portion 33*a* serving as a fulcrum. Of course, the plate thickness and width of the support post portion 33*a* are required to be set to such values as enabling both the beam portions to displace based on the principles of the lever and fulcrum. On the other hand, it is also required to design the support post portion 33*a* so that it has enough strength endurable against stresses produced upon the lever member 41 being operated. The contact 33 is usually formed of an electrically-conductive material, but the contact material is not limited to a metallic plate except its portion coming into electrical contact with the FPC 81.

While the second beam portion 33*c* is displaced upward when the lever member 41 is operated to rotate downward, a design is made in consideration of preventing the second beam portion 33*c* from coming into contact with the cover plate portion 31*f*. Specifically, the housing 31 is designed so that the first and second beam portions 33*b*, 33*c* are positioned with the gaps V, shown in FIG. 3, with respect to the cover plate portion 31*f*.

In the case of removing the FPC 81 from the electrical connector 30, when the control lever portion 41*a* of the lever member 41 is operated upward from below, the spacing between the contact boss 33*d* and the first base surface 33*b* is returned to the state as shown in FIG. 4, allowing the FPC 81 to be easily withdrawn from the electrical connector 30.

In the electrical connector 30 explained above, the boss 33*e* bulging into an arc-shape is formed on the second beam portion 33*c* and meshed with the recess 41*c* formed in the rotating base portion 41*b* of the lever member 41. But, a relative rotating function may be maintained by forming a recess in the second beam portion 33*c* and a boll on the rotating base portion 41*b* as opposed to the above meshing relation.

Figure 11:
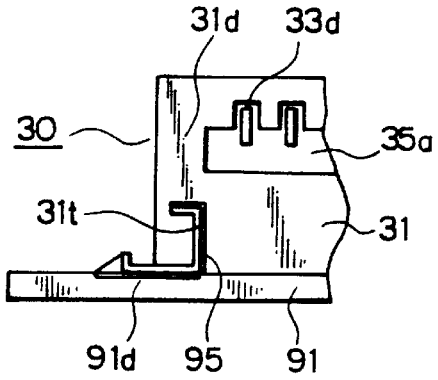
FIG. 11 is a partial front view of the electrical connector of the present invention as looked from a direction in which the FPC is inserted, the view showing a state where the electrical connector is fixed to a circuit board with a hook lug provided on the electrical connector.
Figure 12:
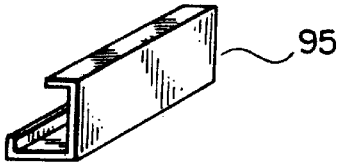
FIG. 12 is a perspective view showing the hook lug shown in FIG. 11.

FIGS. 11 and 12 illustrate an example in which a reinforcing hook lug 95 is fixed to the housing 31. Like general electrical connectors, in the electrical connector 30 explained above, the reinforcing hook lug 95 may be fixed to the housing 31, the hook lug 95 being soldered to the circuit board 91 for increasing the mounting strength of the electrical connector to the circuit board 91, as shown in FIG. 11.

FIG. 11 shows a state where the housing 31 is fixed to the circuit board 91 with the hook lug 95, as looked from the direction in which the FPC 81 is inserted. The hook lug 95 is most preferably formed of a metallic plate material. While the hook lug 95 may have various shapes, the illustrated hook lug 95 is in the form of a substantially rectangular tube partly cut away in the longitudinal direction thereof.

The hook lug 95 is prepared in pair and press-fitted to a press-fit groove 31*t* formed in each of the pair of side plate portions 31*d* of the housing 31. The hook lug 95 is locked to the housing 31 by press-fitting and then soldered to a fixed pad portion 91*d* of the circuit board 91.

The hook lug 95 is locked to the housing 31 by press-fitting in a direction (first direction IV) opposed to the second direction VI in which the first base beam portion 33*h* is locked to the housing 31 by press-fitting. Stated otherwise, the press-fitting direction of the hook lug 95 is opposed to the press-fitting direction of the contacts 33, and the hook lug 95 serves to prevent the electrical connector 30 from shifting from the proper position after it has been mounted to the circuit board 91.

Thus, in the electrical connector 30 of the present invention, the contacts 33 are displaced by the operating means 41 based on the principles of the lever and fulcrum, whereupon the electrically connecting element (FPC or FFC) 81 inserted from the side opposite to the operating means 41 is grasped by the contacts 33 under a contact pressure produced upon deformation of the contacts 33, thereby connecting the contacts 33 and the electrically-conductive portions 81*b* of the FPC 81. In other words, since the operating means 41 or the like is not required to be disposed on the side of the insertion opening 35*a* of the housing 31 through which the electrical connecting element 81 is inserted, the electrical connector 30 can be constructed to have a thinner thickness correspondingly. Further, since no forces are imposed on the housing 31, the strength of the housing 31 is not required to be increased; hence the wall thickness of the housing 31 can be also made thinner. As a consequence, the electrical connector can be mounted on the circuit board 91 with a high density.

Further, the electrical connecting element 81 and the electrical connector 30 can be connected to each other by such simple operation as just rotating the operating means 41, and in addition the operating means 41 is never directly contacted with the electrical connecting element 81. Consequently, the relative position between the contact bosses 33*d* and electrically-conductive portion 81*b* of the electrical connecting element 81 is less likely to shift and the operability is improved.

Figure 13:
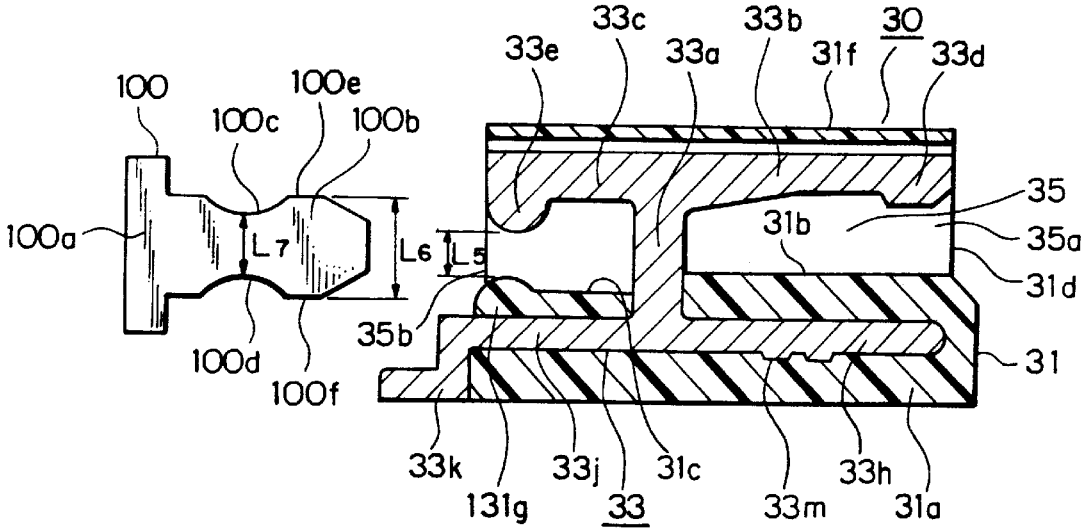
FIG. 13 is a sectional view showing another embodiment of the electrical connector of the present invention.

FIG. 13 shows a second embodiment of the electrical connector of the present invention in which the operating means 41 is constituted by a slider member 100 operated by not rotating, but sliding it, and can develop a similar function as that of the electrical connector 30 explained above. In this embodiment, the contact 33 has basically the same structure in its entirety as in the electrical connector 30 shown in FIG. 3 except that the insertion opening 35*b* at the end of the second beam portion 33*c* is remarkably modified to be adapted for a change of the lever member 41 from the rotating type to the sliding type.

The slider member 100 comprises a slider operating portion 100*a* and a slider portion 100*b* integral with the slider operating portion 100*a*. The slider portion 100*b* extends in the first direction and a second or left-and-right direction perpendicular to the first direction. The slider portion 100*b* has a length enough for it to enter between the second beam portion 33*c* and the second base surface 31*c* to a full extent.

The slider portion 100*b* has first and second slider surfaces 100*e* and 100*f* which face the second beam portion 33*c* and second base surface 31*c*, respectively, when the slider member 100 is inserted between the second beam portion 33*c* and the second base surface 31*c*.

The second base surface 31*c* has a base boss 131*g* formed thereon to project in opposed relation to the boss 33*e*. Two recesses 100*c* and 100*d* are positioned at an intermediate area of the slider portion 100*b*. The recess 100*c* is formed on the first slider surface 100*e* of the slider portion 100*b* to engage the boss 33*e* of the second beam portion 33*c*, on the other hand, the recess 100*d* is formed at the second slider surface 100*f* of the slider portion 100*b* to engage the base boss 131*g* of the second base surface 31*c*.

When the slider member 100 is inserted into the operation opening 35*b* at the end of the second beam portion 33*c*, the slider portion 100*b* enters between base boss 131*g* and the boss 33*e*. At this time, the first beam portion 33*b* is pushed upward by the slider portion 100*b* and displaced through a maximum amount.

With the continued insertion of the slider member 100, the pair of recesses 100*c*, 100*d* are fitted to the boss 33*e* and the base boss 131*g*, respectively, thereby pushing the second beam portion 33*c* upward. This causes the first beam portion 33*b* to displace downward slightly so that the FPC 81 is subject to an appropriate holding force.

Assuming now that the spacing between the boss 33*e* and the base boss 131*g* is L5, the thickness of the slider portion 100*b* inserted through the spacing L5 is L6, and the thickness of the slider portion 100*b* in the area defined by both the recesses 100*c*, 100*d* is L7, these sizes are set to satisfy the relationships of L5<L6 and L6>L7.

It is needless to say that a similar function as stated above can also be achieved even when a recess is formed in the second beam portion 33*c* and a boss is formed on the slider member 100 as opposed to the above fitting relation. Stated otherwise, it is a matter of course that while the base boss 131*g* is formed on the second beam portion 33*c* in this embodiment, the slider member 100 can operate in a similar manner even with a boss formed on the slider member 100 to provide fitting relation opposed to the embodiment.

In addition, it should be understood that the base boss 131*g* and one recess 100*d* engaging the base boss 131*g* are formed, if necessary, from the design point of view.

As described above, according to the electrical connector 30 of the present invention, by displacing the second beam portion 33*c* of the contact 33 upward with the support post portion 33*a* serving as a fulcrum, the first beam portion 33*b* is lowered to establish connection between the contact bosses 33*d* and the electrically-conductive portion 81*b* of the FPC 81 under an appropriate contact pressure.

As mentioned above, the contact 33 is not limited to an H-shape, but may have a T-shape with the support post portion 33*a* fixed to the housing 31. In such a case, though not shown particularly, the support post portion 33*a* is fixedly locked to the housing 31 by providing lock means on the support post portion 33*a*, for example. Since the support post portion 33*a* is held directly on the base plate portion 33*a*, it is possible to design the housing 31 to have a reduced height.

What is claimed is:

1. An electrical connector comprising a housing of a electrically-insulating material which has a base plate portion, and electrically-conductive contacts assembled in said housing, said connector electrically and mechanically coupling an electrical connecting element in the form of a flat plate and said contacts to each other, wherein:

said base plate portion has a first base surface on which said electrical connecting element is placed, and a second base surface positioned adjacent to said first base surface, said contacts each have a support post portion held on said base plate portion and extending upward above said first and second base surfaces, a first beam portion extending from said support post portion in opposed relation to said first base surface, and a second beam portion extending from said support post portion in opposed relation to said second base surface, said first beam portion has a contact portion facing said first base surface, and operating means is interposed between said second beam portion and said second base surface to change the spacing between said second beam portion and said second base surface, and simultaneously to change the spacing between said contact and said first base surface with a joint portion between said second beam portion and said support post portion serving as a fulcrum, so that said electrical connecting element inserted between said first beam portion and said first base surface is tightly grasped therebetween and connected to said contacts.

2. An electrical connector according to claim 1, wherein said contacts each have a first base beam portion extending from said support post portion and held on said base plate portion, and a second base beam portion extending from said support post portion in a direction opposed to said first base beam portion and held on said base plate portion.

3. An electrical connector according to claim 2, wherein at least one of said first and second base beam portions has a terminal portion extending outward beyond said base plate portion for connection to an electrically-conductive portion of a circuit board mounted on said base plate portion.

4. An electrical connector according to claim 2, wherein at least one of said first and second base beam portions has a through-hole connection terminal portion extending outward beyond said base plate portion for connection to an electrically-conductive portion of a circuit board mounted on said base plate portion, said terminal portion being inserted into a through-hole formed in said circuit board and connected to the electrically-conductive portion of said circuit board.

5. An electrical connector according to claim 2, wherein said base plate portion has a retaining hole in which at least one of said first and second base beam portions is held by being press-fitted, and at least one of said first and second base beam portions has lock means formed thereon for locking the one of said first and second base beam portions in said retaining hole.

6. An electrical connector according to claim 2, wherein said support post portion has lock means formed thereon for locking said support post portion to said base plate portion.

7. An electrical connector according to claim 1, wherein said electrical connecting element is a flexible flat cable or a flexible printed circuit.

8. An electrical connector according to claim 1, wherein a boss is formed at a tip end of said second beam portion to project in a direction toward said second base surface, and said operating means is rotatably grasped between said boss and said second base surface.

9. An electrical connector according to claim 1, wherein a recess is formed at a tip end of said second beam portion, said operating means has a boss rotatably meshing with said recess, and said operating means is interposed between said second beam portion and said second base surface.

10. An electrical connector according to claim 1, wherein an arc-shaped boss is formed at a tip end of said second beam portion to project in a direction toward said second base surface, and said operating means is a lever member, said lever member comprising a control lever portion and a rotating base portion joined to one end of said control lever portion, said rotating base portion having an arc-shaped recess rotatably meshed with said boss.

11. An electrical connector according to claim 10, wherein a thickness of said rotating base portion is changed gradually in a direction of rotation thereof to widen the spacing between said second beam portion and said second base surface correspondingly when the control lever portion is pushed to rotate downward from a state where said rotating base portion is rotatably meshed with said boss and the other end of the control lever portion is located above said boss.

12. An electrical connector according to claim 11, wherein the thickness of said rotating base portion is changed to increase gradually so that, while said control lever portion is being pushed to rotate downward, the spacing between said second beam portion and said second base surface is larger before pushing down said control lever portion than after pushing down said control lever portion.

13. An electrical connector according to claim 10, wherein said rotating base portion has a plurality of cam surfaces which are selectively brought into said second base surface depending on before or after said control lever portion is pushed down, in order that the spacing between said second beam portion and said second base surface is changed to displace said second beam portion upon said control lever portion being pushed to rotate downward.

14. An electrical connector according to claim 1, wherein said operating means is a slider member detachably inserted between said second beam portion and said second base surface, said slider member having a first slider surface which faces said second beam portion when said slider member is inserted between said second beam portion and said second base surface and wherein a recess is formed in one of said first slider surface and said second beam portion so that said second beam portion is displaced upon said slider member being operated to slide, and a boss is formed on the other of said first slider surface and said second beam portion.

15. An electrical connector according to claim 14, wherein said slider member being a second slider surface which faces said second base surface when said slider member is inserted between said second beam portion and second base surface and wherein a recess is formed in one of said second slider surface and said second base surface while a boss is formed on the other of said second slider surface and said second base surface.

16. An electrical connector according to claim 1, wherein said housing has a receiving space for receiving said plurality of contacts, said receiving space being defined by a base plate portion, a cover plate portion extending in opposed relation to said base plate portion, and a pair of side plate portions interconnecting said base plate portion and said cover plate portion at both ends thereof, said receiving space has an insertion opening defined on one side thereof in such a configuration as allowing said electrical connecting element to be inserted there, and an operation opening defined on the opposite side to said insertion opening in such a configuration as allowing said operating means to be combined with said operation opening, and said first and second beam portions are placed in said receiving space while leaving a gap with respect to said cover plate portion.

17. An electrical connector according to claim 16, wherein an arc-shaped boss is formed at a tip end of said second beam portion to project in a direction toward said second base surface, and said operating means is a lever member, said lever member comprising a control lever portion and a rotating base portion joined to one end of said control lever portion, said rotating base portion having an arc-shaped recess rotatably meshed with said boss, and wherein shafts are provided in at least ones of said pair of side plate portions and a pair of side surfaces of said rotating base portion positioned to face said pair of side plate portions, and shaft holes capable of rotatably engaging said shafts are formed in the others of said pair of side plate portions and said pair of side surfaces of said rotating base portion positioned to face said pair of side plate portions, in order that said lever member is rotatably assembled in said operation opening.

18. An electrical connector according to claim 1, wherein said housing is provided with a hook lug which is to be soldered to an electrically-conductive portion of a circuit board on which said base plate portion is mounted.

19. An electrical connector according to claim 18, wherein said contacts are locked to said base plate portion by press-fitting, said hook lug is locked to said housing by press-fitting, and a direction in which said hook lug is locked to said housing is opposed to a direction in which said contacts are locked to said base plate portion.

* * * * *